US011834794B2

(12) United States Patent
Philipp

(10) Patent No.: US 11,834,794 B2
(45) Date of Patent: Dec. 5, 2023

(54) METHOD OF OPERATING A TAMPING UNIT OF A TRACK MAINTENANCE MACHINE, AND A TAMPING DEVICE FOR BALLAST BED CONSOLIDATION, AND A TRACK MAINTENANCE MACHINE

(71) Applicant: PLASSER & THEURER EXPORT VON BAHNBAUMASCHINEN GMBH, Vienna (AT)

(72) Inventor: Thomas Philipp, Leonding (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 833 days.

(21) Appl. No.: 16/763,133

(22) PCT Filed: Nov. 20, 2018

(86) PCT No.: PCT/EP2018/081932
§ 371 (c)(1),
(2) Date: May 11, 2020

(87) PCT Pub. No.: WO2019/120829
PCT Pub. Date: Jun. 27, 2019

(65) Prior Publication Data

US 2020/0392672 A1 Dec. 17, 2020

(30) Foreign Application Priority Data

Dec. 21, 2017 (AT) ..... A 493/2017

(51) Int. Cl.
*E01B 27/16* (2006.01)
*E01B 35/00* (2006.01)
*B06B 1/18* (2006.01)

(52) U.S. Cl.
CPC ..... *E01B 27/16* (2013.01); *E01B 35/00* (2013.01); *B06B 1/183* (2013.01); *E01B 2203/127* (2013.01); *E01B 2203/16* (2013.01)

(58) Field of Classification Search
CPC ..... E01B 27/16; E01B 27/17; E01B 35/00; E01B 35/02; E01B 35/04; E01B 35/10;
(Continued)

(56) References Cited

U.S. PATENT DOCUMENTS 5,142,988 A * 9/1992 Ganz ..... E01B 27/17 104/7.1
5,591,915 A * 1/1997 Theurer ..... E01B 35/00 73/146
(Continued)

FOREIGN PATENT DOCUMENTS

AT 515801 A4 * 12/2015 ..... E01B 27/16
AT 515801 B1 12/2015
(Continued)

*Primary Examiner* — Zachary L Kuhfuss
*Assistant Examiner* — Cheng Lin
(74) *Attorney, Agent, or Firm* — Laurence A. Greenberg; Werner H. Stemer; Ralph E. Locher

(57) ABSTRACT

In a method of operating a tamping unit of a track maintenance machine, the track maintenance machine having the tamping unit is first provided on a track bed. The tamping unit is displaced relative to the track bed. A driving force, acting on the tamping unit and required for the displacement, and acceleration acting on the tamping unit are determined. A ballast force acting between the tamping unit and the track bed is determined by way of the driving force and the acceleration, and is evaluated.

12 Claims, 6 Drawing Sheets

(58) Field of Classification Search
CPC ..... E01B 2203/10; E01B 2203/127; E01B 2203/16; B60B 1/18; B60B 1/183
See application file for complete search history.

(56) References Cited

U.S. PATENT DOCUMENTS

| | | | | |
|---|---|---|---|---|
| 6,805,059 | B2 | 10/2004 | Theurer et al. | |
| 10,036,128 | B2 * | 7/2018 | Salciccia | E01B 27/16 |
| 2019/0055698 | A1 | 2/2019 | Hofstaetter et al. | |

FOREIGN PATENT DOCUMENTS

| | | | | | |
|---|---|---|---|---|---|
| CN | 1114994 | A | | 1/1996 | |
| CN | 1472392 | A | | 2/2004 | |
| CN | 107227661 | A | | 10/2017 | |
| EP | 3239398 | A1 | * | 11/2017 | B06B 1/183 |
| EP | 3239398 | A1 | | 11/2017 | |
| GB | 2451310 | A | * | 1/2009 | E01B 27/16 |
| GB | 2451310 | A | | 1/2009 | |
| WO | 2014102401 | A1 | | 7/2014 | |
| WO | 2017129215 | A1 | | 8/2017 | |

* cited by examiner

METHOD OF OPERATING A TAMPING UNIT OF A TRACK MAINTENANCE MACHINE, AND A TAMPING DEVICE FOR BALLAST BED CONSOLIDATION, AND A TRACK MAINTENANCE MACHINE

BACKGROUND OF THE INVENTION

Field of the Invention

The invention relates to a method of operating a tamping unit of a track maintenance machine and further to a tamping device for track bed consolidation and to a track maintenance machine.

Rail-guided track maintenance machines are used for maintenance of a track bed. For track bed consolidation, track maintenance machines of this type have a tamping device including a displaceable tamping unit. In operation, the tamping unit is displaced repeatedly between a reset position, in which the tamping unit is not in engagement with the track bed, and an engagement position in which the tamping unit is in engagement with the track bed. In this, high static and dynamic loads are acting on the tamping unit. In order to maintain the functionality of highly stressed parts of the tamping unit, time- and cost-intensive check- and maintenance operations are carried out regularly.

SUMMARY OF THE INVENTION

It is the object of the invention to provide a method of operating a tamping unit of a track maintenance machine which increases the performance and efficiency of the tamping unit.

This object is achieved with a method including the features of the independent method claim. According to the invention, the realization was made that the ballast force acting between the tamping unit and the ballast bed, in particular along a direction of displacement of the tamping unit, is material to the strain on the tamping unit, and that the same can be precisely determined by way of the driving force and the acceleration. By determining and evaluating the ballast force, the tamping unit can be operated efficiently and economically. It is possible, for example, to identify heavily stressed parts and to design and maintain these in accordance with the strain. Additionally, while ensuring a high ratio between a treatment speed and an energy consumption and while taking into account the ballast forces crucial for wear, the treatment of the track bed can be carried out in such a way that the downtimes to be expected as a result of maintenance work are reduced. Thus, by determining and evaluating the ballast force, the performance and efficiency of the track maintenance machine can be enhanced.

The displacement of the tamping unit relative to the track bed takes place at least, in particular exclusively, in vertical direction. The displacement of the tamping unit takes place preferably between the reset position and the engagement position. In the reset position, the tamping unit is raised and is not in engagement with the track bed. In particular, the tamping unit can be arranged in the reset position in vertical direction in such a way that it is positioned completely above track sleepers and/or tracks. Preferably, the tamping unit comprises at least two, in particular at least four, tamping tines. In the engagement position, the tamping unit—in particular the at least two tamping tines—penetrate into the track bed. In a feed position situated between the reset position and the engagement position, the tamping unit makes contact with the track bed. The track bed consolidation can take place during the displacement from the feed position up to the engagement position.

In order to determine the ballast force, the driving force acting on the tamping unit and required for the displacement is determined. The term driving force means that force which is required for displacing the tamping unit between the reset position and the engagement position, in particular in vertical direction. The driving force can be measured, for example, by means of a force sensor. The driving force can be detected at the tamping unit and/or at the unit carrier and/or at a drive device acting between the tamping unit and the unit carrier.

An acceleration sensor can be used for determining the acceleration acting on the tamping unit. The acceleration can be measured at the tamping unit and/or at the drive device.

The ballast force is determined by way of the driving force and the acceleration. The term ballast force means that force which acts between the track bed and the tamping unit, in particular the at least two tamping tines, and is oriented along the displacement between the reset position and the engagement position, in particular in vertical direction. By taking into account both the driving force as well as the acceleration of the tamping unit, the ballast force can be determined reliably and precisely in spite of the rough operating conditions.

The method ensures the increased performance and efficiency of the track maintenance machine. The position of the tamping unit, in particular in vertical direction, can be measured in a particularly reliable and robust manner. It is possible to use position sensors used for displacing the tamping unit, as a result of which the integration of additional sensors is omitted. Thus, recording the acceleration is particularly efficient. The position can be detected at the drive device. The position can also be detected at a support device by means of which the tamping unit is supported relative to the unit carrier. The position can be detected by means of a position sensor, in particular a distance encoder or a rotary encoder, in the shape of a potentiometer or a Hall sensor or a wire-actuated encoder. For measuring the temporal change of the position, the temporal progression of the position can be determined by means of an evaluation unit in a manner differentiated according to time, or the change of position can be determined over a concrete time step. From the temporal change of the position, i.e. the speed, the acceleration is determined as temporal change of the speed. Preferably, the position and thus the acceleration relative to the unit carrier is detected. When taking into account gravitational acceleration, the absolute acceleration of the tamping unit can be determined.

The method ensures the increased performance and efficiency of the track maintenance machine. When taking into account the inertial force dependent on the mass, the ballast force can be determined with particular precision. The mass of the tamping unit can be weighed prior to installation into the track maintenance machine, or as installed on the track maintenance machine. Alternatively, the mass of the tamping unit can be determined in the reset position by measuring the driving force. In the non-accelerated state, the weight force and thus the mass of the tamping unit can be determined by way of the driving force.

The method ensures the increased performance and efficiency of the track maintenance machine. The fluidically operated drive device is robust in operation and ensures delivery of the performance required for treatment of the track bed. Determining the driving force by measuring at least one fluid pressure acting on the drive device can take place in a particularly robust manner. By using pressure sensors required for regulating the pressure, the tamping unit can be manufactured particularly efficiently by avoiding redundancies. Preferably, the drive device has at least one hydraulic cylinder and/or at least one pneumatic cylinder. A piston guided within the respective cylinder is connected to a piston rod and has a piston ring surface facing towards the piston rod, and a piston surface lying opposite the piston ring surface. Preferably, the measurement of the fluid pressure takes place by detecting a piston pressure acting on the piston surface and/or a piston ring pressure acting on the piston ring surface.

The method ensures the increased performance and efficiency of the track maintenance machine. During operation of the track maintenance machine, the tamping unit, in particular the at least two tamping tines, the drive device and the support device are subjected to high mechanical strain. The ballast force is crucial for the strain on the tamping unit. By evaluation of the strain by way of the ballast force, the trackmm can be designed to be robust and operated efficiently and economically.

The method ensures the increased performance and efficiency of the track maintenance machine. During displacement of the tamping unit between the reset position and the engagement position, the ballast force acting on the tamping unit varies considerably. By determining the strain by way of the temporal progression of the ballast force, changes in the ballast force can be taken into account. Preferably, the strain on the tamping unit is determined over at least one tamping cycle. A tamping cycle encompasses the displacement of the tamping unit from the reset position to the engagement position and back from the engagement position to the reset position. The strain on the tamping unit can also be determined over the entire operating period of the tamping unit. Preferably, the strain on the tamping unit, in particular on the at least two tamping tines, is determined over at least the duration of a tamping cycle, in particular over several tamping cycles and, in particular, over the entire operating period. Beside the static strain, the temporal progression of the ballast force also permits conclusions as to the dynamic strain on the tamping unit. With the knowledge of the dynymic strain, maintenance cycles can be optimized and the maintenance expense reduced.

The method ensures the increased performance and efficiency of the track maintenance machine. Depending on the track bed to be treated, the ballast force varies within and between different tamping cycles. It was recognized that the ballast force amplitudes, i.e. the amplitudes of the changing ballast force, are of great significance for the strain on the tamping unit. For determining the ballast force amplitudes, the temporal progression of the ballast force between a first and a second measuring point can be recorded, wherein the ballast force at the first and at the second measuring point is equal, and wherein the second measuring point is determined as the first time that said ballast force is reached again. The ballast force amplitude is determined as the difference between the maximal ballast force value and the minimal ballast force value between the first and the second measuring point.

The method ensures the increased performance and efficiency of the track maintenance machine. For determining the load spectrum, the cumulative frequency of the ballast force amplitudes is detected. Preferably, the range of the occurring ballast force amplitudes is first subdivided into ballast force amplitude sections. For determining the load spectrum, the frequency of the occurring ballast force amplitudes can be counted which fall within the respective ballast force amplitude section. Thus, the load spectrum is informative as to the magnitude and frequency of the varying strain acting on the tamping unit. The load spectrum is thus suited especially for evaluating the dynamic strain acting on the tamping unit.

The method ensures the increased performance and efficiency of the track maintenance machine. During penetration of the at least two tamping tines into the track bed, the ballast work is transmitted between the tamping unit and the track bed. The ballast work correlates to the strain on the tamping unit. The strain on the tamping unit can be determined particularly efficiently by means of the ballast work. For determining the ballast work, the ballast force and the position can be determined in each case after certain time steps. Subsequently, the change of the position over this time step can be multiplied by the ballast force, in particular the average ballast force over this time step. Alternatively, the ballast force can also be integrated over the position.

The method ensures the increased performance and efficiency of the track maintenance machine. For determining the wear condition, the strain acting on the tamping unit can be compared to a maximally allowable strain. On the basis of the wear condition, it is possible to predict how long the tamping unit can still be operated before it fails, particularly before individual parts of the tamping unit fail. By way of the wear condition, it is also possible to draw conclusions as to the necessity of maintenance operations, in particular of an exchange of the tamping unit. With knowledge of the wear condition, the track maintenance machine, in particular the tamping unit, can be operated for a longer period while exploiting the actual life span, thus reducing downtimes and decreasing maintenance costs.

The method ensures the increased performance and efficiency of the track maintenance machine. The setting of at least one process parameter for controlling the tamping unit by way of the strain ensures the exertion of influence on the strain on the tamping unit. Process parameters can be, for example, a frequency and/or an amplitude of the vibration- and/or displacement component transmitted to the at least one tamping tine, a feed speed of the tamping unit between the reset position and the engagement position, the acceleration of the tamping unit, and the fluid pressure acting on the drive device. Advantageously it is thus achieved that the at least one process parameter can be set in dependence on the track bed to be treated and the strain resulting from the condition of the particular track bed. Depending on the track bed, it is thus possible to optimize the energy consumption and the treatment speed while taking into account the strain acting on the tamping unit.

The method ensures the increased performance and efficiency of the track maintenance machine. By changing at least one process parameter when exceeding a threshold value of the strain, it is possible to counteract both an overstressing of the tamping unit as well as a treatment speed of the track bed which is too slow. Preferably, when exceeding an upper threshold value, the at least one process parameter is reduced in such a way that the strain on the tamping unit decreases. When falling below a lower threshold value, the at least one process parameter can be changed in such a manner that the strain increases. Advantageously, a difference between the upper and the lower threshold value accomplishes that the at least one process parameter does not undergo a constant change.

The method ensures the increased performance and efficiency of the track maintenance machine. By setting the at least one process parameter in such a way that a strain limit value is not exceeded, a failing of the tamping unit, in particular of the at least two tamping tines, can be reliably avoided. The strain limit value can be a static and/or dynamic strength property of the tamping unit, determined in particular by experimentation, in particular of individual parts of the tamping unit. The at least one process parameter can be changed continuously on the basis of the strain, or the change can take place in discrete steps. For example, a vibration frequency of the at least two tamping tines can be changed continuously between 30 Hz and 50 Hz. Alternatively, the vibration frequency in a first mode is 35 Hz and, in a second mode, 45 Hz. The tamping unit can be operated in the first and in the second mode, wherein it is possible to switch between the first mode and the second mode on the basis of the strain. The tamping unit can be operable in more than two operating modes. Each operating mode differs from another operating mode by in at least one process parameter.

On the basis of the ballast force and/or the strain, various types of tamping units can be compared to one another and evaluated. The ballast force and/or the strain can also be used for optimizing the tamping unit, in particular the kinematics and/or the support and/or the materials used and/or the structural design.

It is a further object of the invention to provide a tamping device for track bed consolidation which shows increased performance and efficiency.

This object is achieved by way of a tamping device having the features of the independent tamping device claim. The advantages of the tamping device according to the invention correspond to the advantages of the method according to the invention. The tamping device can be developed further in particular with the features of at least one of the method claims. Preferably, the tamping unit is supported on the unit carrier for displacement in vertical direction. The drive device can comprise a hydraulic cylinder. For engagement in the track bed, the tamping unit has preferably at least two, in particular at least four, tamping tines. The driving force sensor system can include at least one pressure sensor and/or at least one force sensor. The acceleration sensor system can include at least one speed sensor and/or at least one position sensor and/or at least one acceleration sensor. The position sensor can be designed as a contact-less sensor. The position sensor can be arranged between the tamping unit and the unit carrier, in particular at the drive device. Preferably, the at least one position sensor is designed as a potentiometer and/or as a Hall sensor and/or as a wire-actuated encoder.

It is a further object of the invention to provide a track maintenance machine with a tamping device which has increased performance and efficiency.

This object is achieved with a track maintenance machine having the features of the independent machine claim. The advantages of the track maintenance machine according to the invention correspond to the advantages of the tamping device according to the invention. The track maintenance machine can be developed further in particular with the features of at least one of the other claims.

BRIEF DESCRIPTION OF THE SEVERAL VIEWS OF THE DRAWING

Additional features, advantages and details of the invention become apparent from the following description of an example of embodiment. There is shown in.

DETAILED DESCRIPTION OF THE INVENTION

Figure 1:
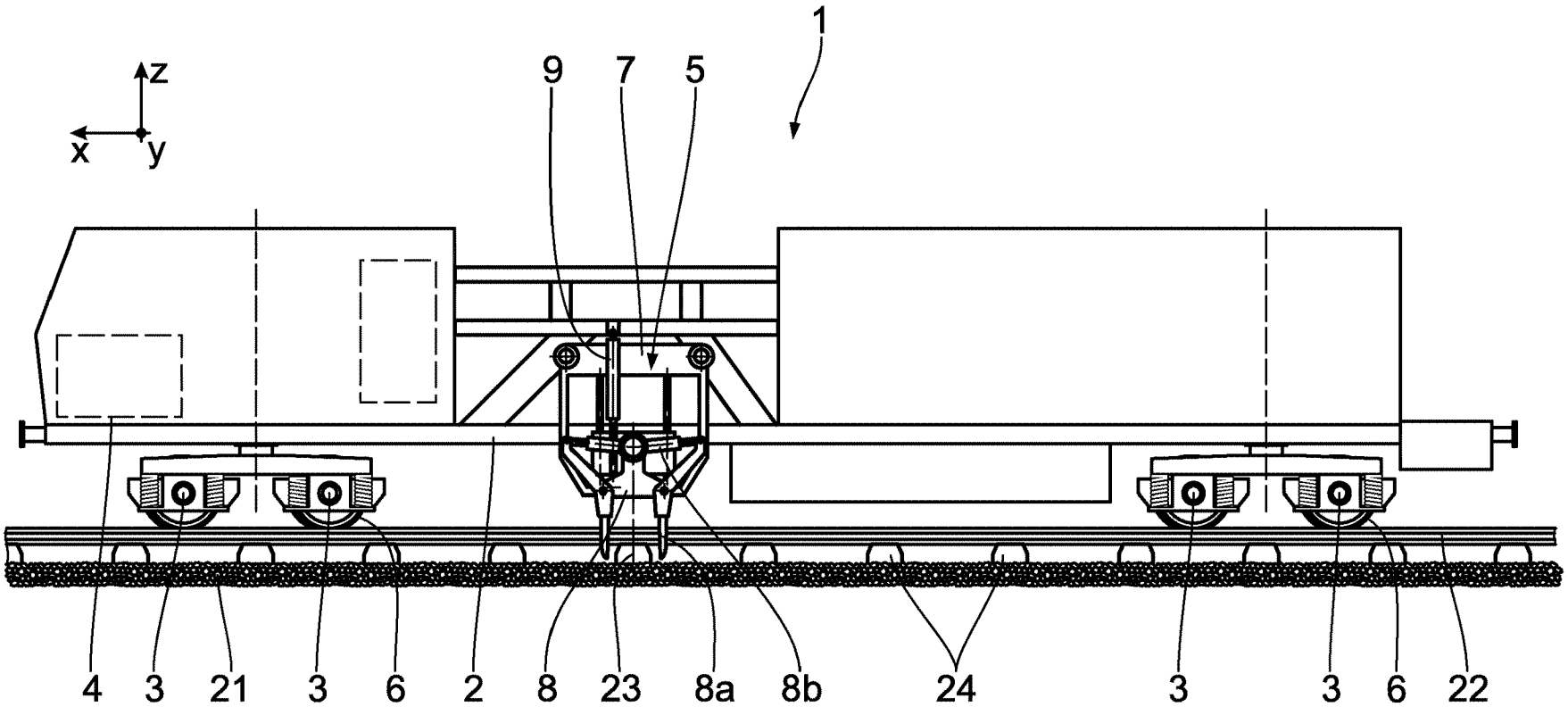
FIG. 1 a schematic representation of a rail-guided track maintenance machine having a tamping device for track bed consolidation, FIG. 2 a schematic front view of the tamping device in FIG. 1, wherein the tamping device comprises a tamping unit having four tamping tines and wherein the tamping tines are in engagement with a track bed, FIG. 3 a schematic side view of the tamping device in FIG. 1, wherein a driving force, an inertial force and a ballast force act on the tamping unit, FIG. 4 progressions of the driving force, the inertial force and the ballast force over time and for an individual tamping cycle, FIG. 5 progression of the ballast force over time for six tamping cycles, FIG. 6 progression of measured load amplitudes of the ballast force over a number of stress cycles, and FIG. 7 progressions of a position of the tamping unit, the ballast force and a ballast work over time.
Figure 2:
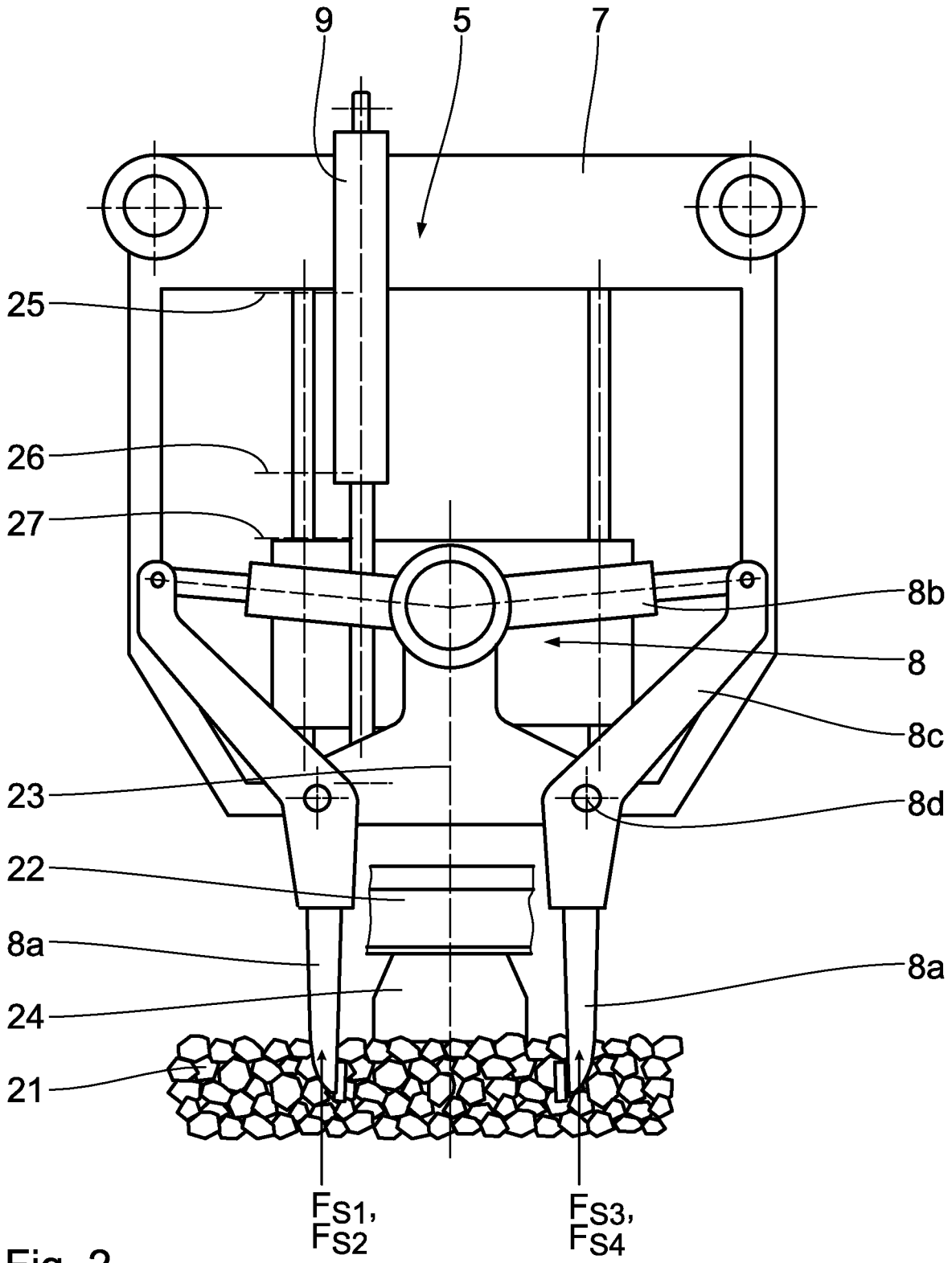
Figure 3:
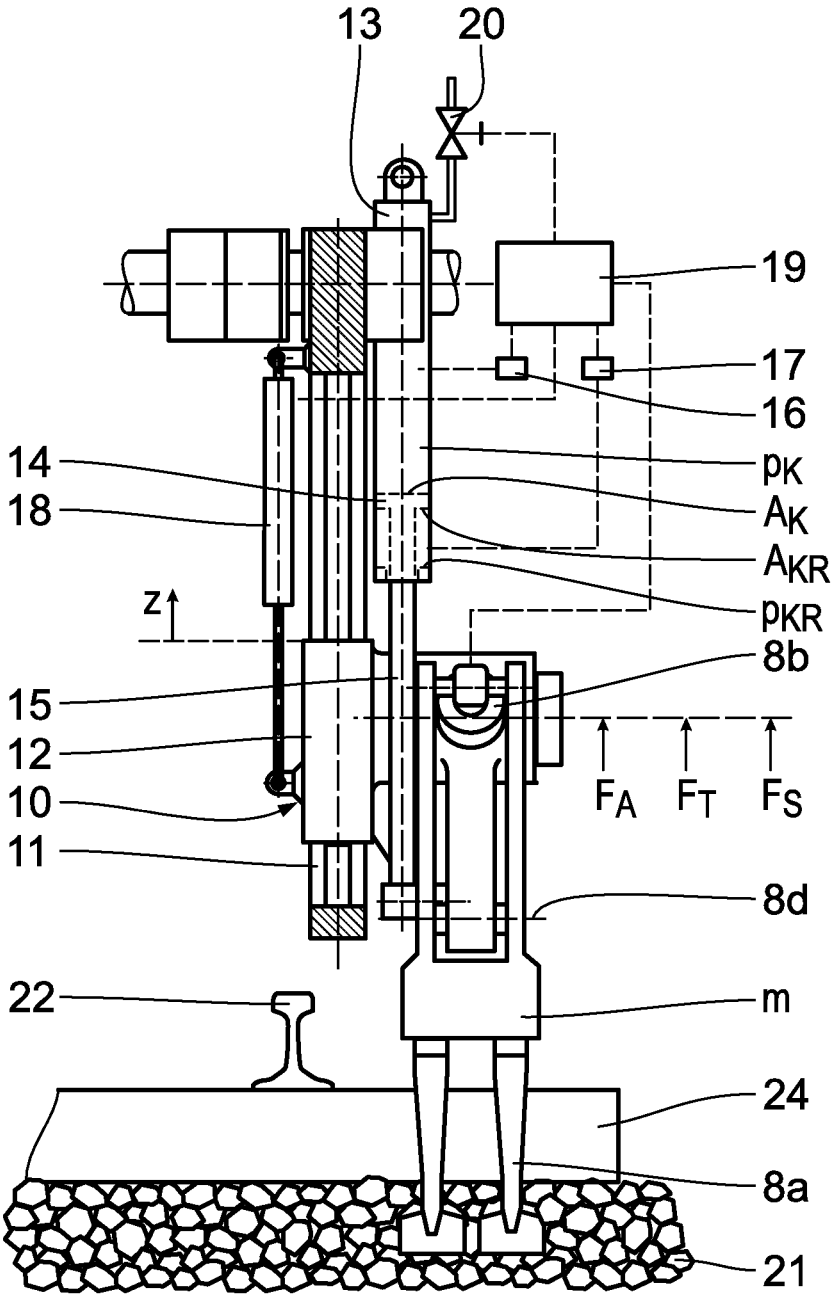

A track maintenance machine 1 comprises a machine frame 2, at least two axles 3 supported on the machine frame 2, a machine drive 4, and a tamping device 5 for track bed consolidation. The axles 3 are arranged on the track maintenance machine 1 at a distance from one another along a horizontal x-direction. The x-direction, together with a vertical z-direction and a horizontal y-direction, forms a machine-fixed coordinate system. Rail-guidable wheels 6 are rotatably mounted on the axles 3. The machine drive 2 is designed for rotary actuation of the wheels 6 of at least one of the axles 3.

The tamping device 5 has a unit carrier 7 and a tamping unit 8 mounted relative to the same in the z-direction. The tamping unit 8 comprises four tamping tines 8*a* and a consolidation drive 8*b*. The tamping tines 8*a* are installed in each case on a tamping tine carrier 8*c* and mounted via the latter for rotation about a carrier axis 8*d*. By means of the consolidation drive 8*b*, the tamping tine carriers 8*c* can be rotatably driven about the respective carrier axis 8*d*.

The tamping device 5 is mounted on the machine frame 2 by way of the unit carrier 7. The tamping unit 8 is displaceable relative to the unit carrier 7. To that end, a linear bearing 10 is formed between the unit carrier 7 and the tamping unit 8. The linear bearing 10 has bearing rails 11 mounted on the unit carrier 7 and bearing sleeves 12 connected to the tamping unit 8.

The tamping device further has a drive device 9. The drive device 9 includes a hydraulic cylinder 13. The hydraulic cylinder 13 acts between the unit carrier 7 and the tamping unit 8. A hydraulic piston 14 with a piston rod 15 attached thereto is mounted for linear displacement in the hydraulic cylinder 13. The hydraulic piston 14 has a piston ring surface $A_{KR}$ facing towards the piston rod 15, and a piston surface $A_K$ facing away from the piston rod 15. In this, a piston pressure $p_K$ of a hydraulic fluid located in the hydraulic cylinder 13 acts on the piston surface $A_K$. A piston ring pressure $p_{KR}$ of the hydraulic fluid acts on the piston ring surface $A_{KR}$. From the piston pressure $p_K$ acting on the piston surface $A_K$ and the piston ring pressure $p_{KR}$ acting on the piston ring surface $A_{KR}$, a driving force $F_A$ results which is transmitted as a whole via the piston rod 15 to the tamping unit 8.

The tamping device 1 includes a driving force sensor system for recording a first measuring value $P_K$, $p_{KR}$, $F_A$ corresponding to the driving force $F_A$. The driving force sensor system has a piston pressure sensor 16 for recording the piston pressure $p_K$ and a piston ring pressure sensor 17 for recording the piston ring pressure $p_{KR}$. From the piston pressure $p_K$ acting on the piston surface $A_K$ and from the piston ring pressure $p_{KR}$ acting on the piston ring surface $A_{KR}$, it is possible to draw a conclusion as to the driving force $F_A$ acting overall via the piston rod 15 on the tamping unit 8. The driving force $F_A$ is computed as follows:

$$F_A=p_{KR}\cdot A_{KR}-p_K\cdot A_K \quad (1)$$

The tamping device 1 has an acceleration sensor system for recording a second measuring value corresponding to an acceleration a, of the tamping unit 8, the position z and/or the speed $v_z$. The acceleration sensor system is designed as a path transducer 18. The path transducer 18 is mounted on the unit carrier 7 and on the tamping unit 8. The path transducer 18 is designed for recording the position z and the speed $v_z$ of the tamping unit 8 relative to the unit carrier 7 in the z-direction.

For determining the ballast force $F_S$ acting on the tamping unit 8, the tamping device 5 includes an evaluation unit 19. The evaluation unit 19 is in signal contact with the piston pressure sensor 16, the piston ring pressure sensor 17 and the path transducer 18. Additionally, the evaluation unit 19 is in signal contact with a pressure regulator 20. The pressure regulator 20 is designed for regulating the piston pressure $p_K$ and the piston ring pressure $p_{KR}$ to a respective target value. The respective target value for the piston pressure $P_K$ and the piston ring pressure $p_{KR}$ can be prescribed by the evaluation unit 19.

The operation of the track maintenance machine 1 and the operation of the tamping unit 8 are described below:

For creating and/or maintaining a track bed 21, the track maintenance machine 1 is moved by means of the machine drive 4 in the x-direction along a track 22. During this, a center axis 23 of the tamping device 5 is positioned centrally over a railroad sleeper 24 arranged on the track bed 21 and supporting the rails 22.

At the start of the process of track bed consolidation, the tamping unit 8 is situated in a reset position 25. The bearing sleeve 12 is situated at an upper end of the linear bearing 10, and the piston rod 15 plunges to a large extent into the hydraulic piston 14. The tamping tines 8*a* mounted on the tamping unit 8 are not in engagement with the track bed 21. The piston surface $A_K$ is pressurized with the piston pressure $P_K$, and the piston ring surface $A_{KR}$ is pressurized with the piston ring pressure $p_{KR}$. By means of the evaluation unit 19, the driving force $F_A$ acting by the hydraulic piston 14 on the tamping unit 8 is determined. To that end, the piston pressure $p_K$ is multiplied with the piston surface $A_K$, and the piston ring pressure $p_{KR}$ is multiplied with the piston ring surface $A_{KR}$. Thus, the following applies for the driving force $F_A$:

$$F_A=p_{KR}\cdot A_{KR}-p_K\cdot A_K \quad (2)$$

In the reset position 25, the tamping unit 8 rests relative to the unit carrier 7, and only the gravitational acceleration g acts on the tamping unit 8. For the acceleration $a_z$ of the tamping unit 8 relative to the unit carrier 7, $a_z=0$ applies, and $F_S=0$ applies for the ballast force $F_S$. For the equilibrium of forces on the tamping unit 8 along the z-direction, the following applies:

$$\Sigma F_z=F_A+F_T+F_S=F_A-m^*(a_z+g)+F_S=0 \quad (3)$$

Prior to the start of operation of the tamping device 5, the mass m of the tamping unit is determined in the reset position 25 by means of the evaluation unit 19. Taking into account the limiting conditions prevailing in the reset position 25, the following applies for the mass m:

$$m=F_A/g \quad (4)$$

The mass m of the tamping unit 8 is stored in a memory element of the evaluation unit 19.

The consolidation of the track bed 21 is subdivided into individual tamping cycles. During the tamping cycle, the tamping unit 8 is shifted along the z-direction from the reset position 25 into a squeezing position 26 and an engagement position 27. In the squeezing position 26, the tamping tines 8*a* touch the track bed 21, but do not penetrate the same. In the engagement position 27, the tamping tines 8*a* penetrate into the track bed 21. The tamping cycle is finished when the tamping unit 8 is shifted from the engagement position 27 via the squeezing position 26 back again into the reset position 25. The ballast force $F_S$ is determined by means of the evaluation unit 19 from the inertial force $F_T$ and the driving force $F_A$. For determining the inertial force $F_T$, first the speed $v_z$ of the tamping unit 8 relative to the unit carrier 7 in the z-direction is determined as change of the position over the time t. The acceleration $a_z$, in turn, is determined as change of the speed $v_z$ over the time t. The acceleration $a_z$ is thus determined as follows:

$$a_z(t)=\frac{dv_z(t)}{dt}=\frac{d^2z(t)}{dt^2} \quad (5)$$

With the start of the tamping cycle starts the evaluation of the ballast force $F_S(t)$ dependent on the time t. By way of the driving force $F_A(t)$ and the acceleration $a_z(t)$ as well as with the knowledge of the mass m and the gravitational acceleration g, the ballast force $F_S(t)$ is determined as follows:

$$F_S(t)=-F_T(t)-F_A(t)=m[a_z(t)+g]-F_A(t) \quad (6)$$

In order to shift the tamping unit 8 from the reset position 25 against the z-direction into the squeezing position 26, first the drive device 9 is activated. During this, the piston pressure $p_K$ is increased and the piston ring pressure $p_{KR}$ is lowered. The driving force $F_A$ acting via the piston rod 15 on the tamping unit 8 is increased counter to the z-direction. From the driving force $F_A$, the acceleration $a_z$ acting on the tamping unit 8 results, which is oriented against the z-direction and leads to an increase of the speed $v_z$ of the tamping unit 8 in the direction of the track bed 21. The tamping unit 8 is displaced against the z-direction. The inertial force $F_T$ of equal magnitude acts counter to the driving force $F_A$. Prior to contact of the tamping tines 8*a* with the track bed 21, the ballast force $F_S$ equals zero.

In the squeezing position 26, the tamping tines 8*a* get to engage the track bed 21. Between the squeezing position 26 and the engagement position 27, the partial ballast forces $F_{S1}$, $F_{S2}$, $F_{S3}$ and $F_{S4}$ additionally act on the tamping unit 8 in the z-direction via the four tamping tines 8*a*. the partial ballast forces $F_{S1}$, $F_{S2}$, $F_{S3}$ and $F_{S4}$ add up to the ballast force $F_S$. Throughout the displacement between the squeezing position and the engagement position 27, the ballast force $F_S$ is not equal to zero.

Figure 4:
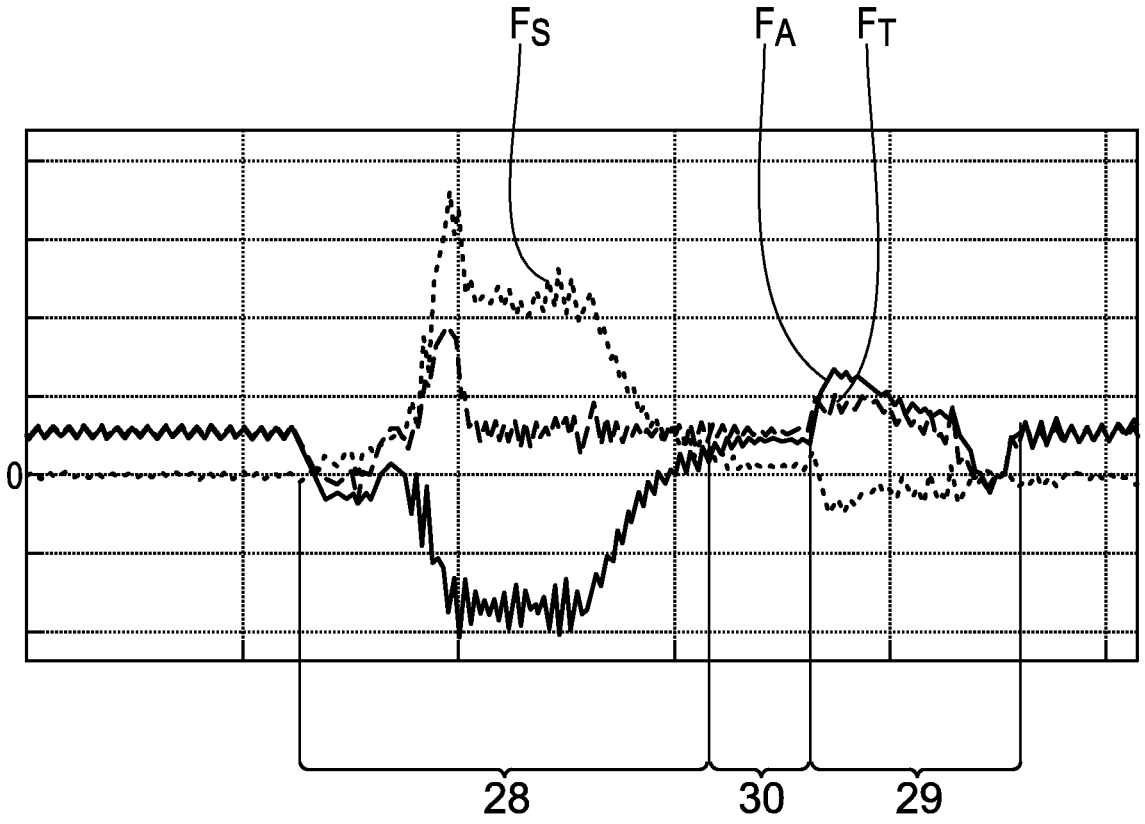

The progressions of the driving force $F_A$, the inertial force $F_T$ and the ballast force $F_S$ over the time t for the duration of a tamping cycle are shown in detail in FIG. 4. The displacement of the tamping unit 8 between the reset position 25 and the engagement position 27 takes place in the squeezing phase 28. The return phase 29 follows the squeezing phase 28 with a time delay.

In the return phase 29, the tamping unit 8 is shifted back from the engagement position 27 via the squeezing position 26 into the reset position 25. To that end, the drive device 9 is operated in such a manner that the piston pressure $p_K$ is reduced and the piston ring pressure $p_{KR}$ is increased. The hydraulic cylinder 13 thus produces the driving force $F_A$ which is now oriented in the z-direction. The tamping unit 8 is accelerated in the z-direction because of the driving force $F_A$. The acceleration $a_z$ is oriented in the z-direction and results in a speed $v_z$, which increases in the z-direction, and the displacement of the tamping unit 8 in the z-direction. Between the engagement position 27 and the squeezing position 26, the ballast force $F_S$ acts on the tamping unit 8. Between the squeezing position 26 and the reset position 25, only the drive force $F_A$ and the inertial force $F_T$, which is of equal magnitude and oriented oppositely, act on the tamping unit 8, wherein the ballast force $F_S$ equals zero.

During the tamping cycle, the tamping tines 8*a* are set in vibration by activation of the consolidation drive 8*b*. To that end, the consolidation drive 8*b* drives the tamping tine carrier 8*c* essentially in horizontal direction, as a result of which the tamping tine carrier 8*c* and the tamping tines 8*a* mounted thereon rotate about the respective carrier axis 8*d*. The motion of the tamping tines 8*a* about the respective carrier axis 8*d* includes essentially two motion components. A vibration component causes a merely small rotation amplitude of the tamping tines 8*a* about the respective carrier axis 8*d*, wherein a vibration frequency $f_S$ is between 35 Hz and 45 Hz. The vibration frequency acts on the tamping tines 8*a* during the entire tamping cycle. In addition to the vibration component, the tamping tines 8*a* are actuated with a displacement component. The displacement component has a greater rotation amplitude than the vibration component and a displacement frequency of about 0.5 Hz. In the engagement position 27, the tamping tines 8*a* are rotated about the respective carrier axis 8*d* in such a way that the tamping tines 8*a*—spaced from one another in the x-direction—move towards one another. In the reset position 25, the displacement component is oriented such that the tamping tines 8*a* move apart from one another again. The actuation of the tamping tines 8*a* with the displacement component follows in the displacement phase 30. As a result of the superimposed actuation of the tamping tines 8*a* with the vibration component and the displacement component, the track bed 21 is consolidated.

Figure 5:
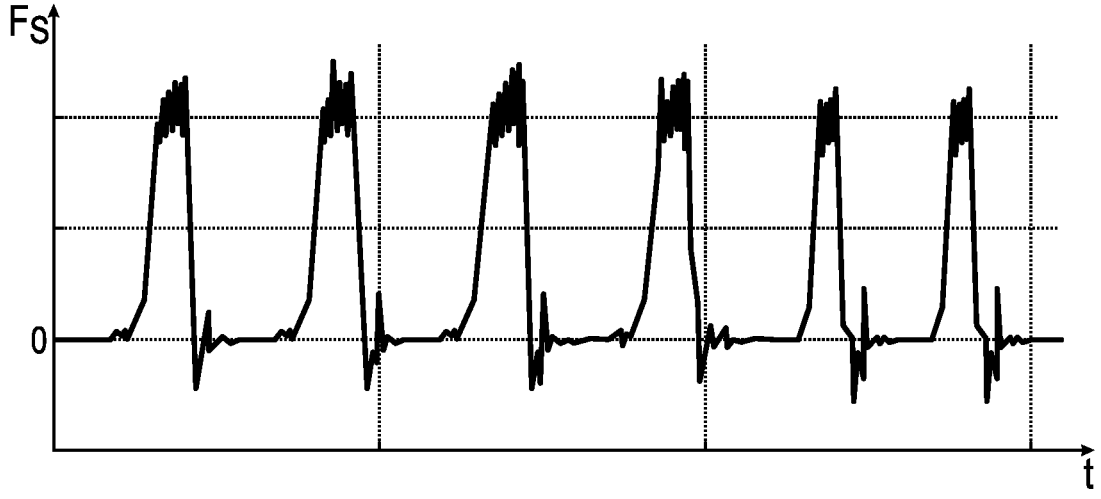

The tamping cycle is finished as soon as the tamping unit 8 is in the reset position 25 again. For further consolidation of the track bed 21, the track maintenance machine 1 is displaced in the x-direction until the center axis 23 is arranged centrally above the railway sleeper 24 following next in the x-direction. Here the tamping cycle is repeated. The progression of the ballast force $F_S$ over the time t is shown for six successive tamping cycles in FIG. 5.

By means of the evaluation unit 19, the strain on the tamping udv 5 is determined by way of the temporal progression of the ballast force $F_S$. The strain is determined on the basis of ballast force amplitudes $S_{F_S}$ of the ballast force $F_S$. The ballast force $F_S$ is an oscillating load varying over time. The ballast force amplitude $S_{F_S}$ is determined as the difference of a maximal ballast force $F_S$ and a minimal ballast force $F_S$ within an oscillation. In addition to the ballast force amplitudes $S_{F_S}$, the cumulative frequency $N_{F_S}$ of the respective ballast force amplitude $S_{F_S}$ is determined. For establishing the strain, a load spectrum is determined on the basis of the cumulative frequency $N_{F_S}$.

Figure 6:
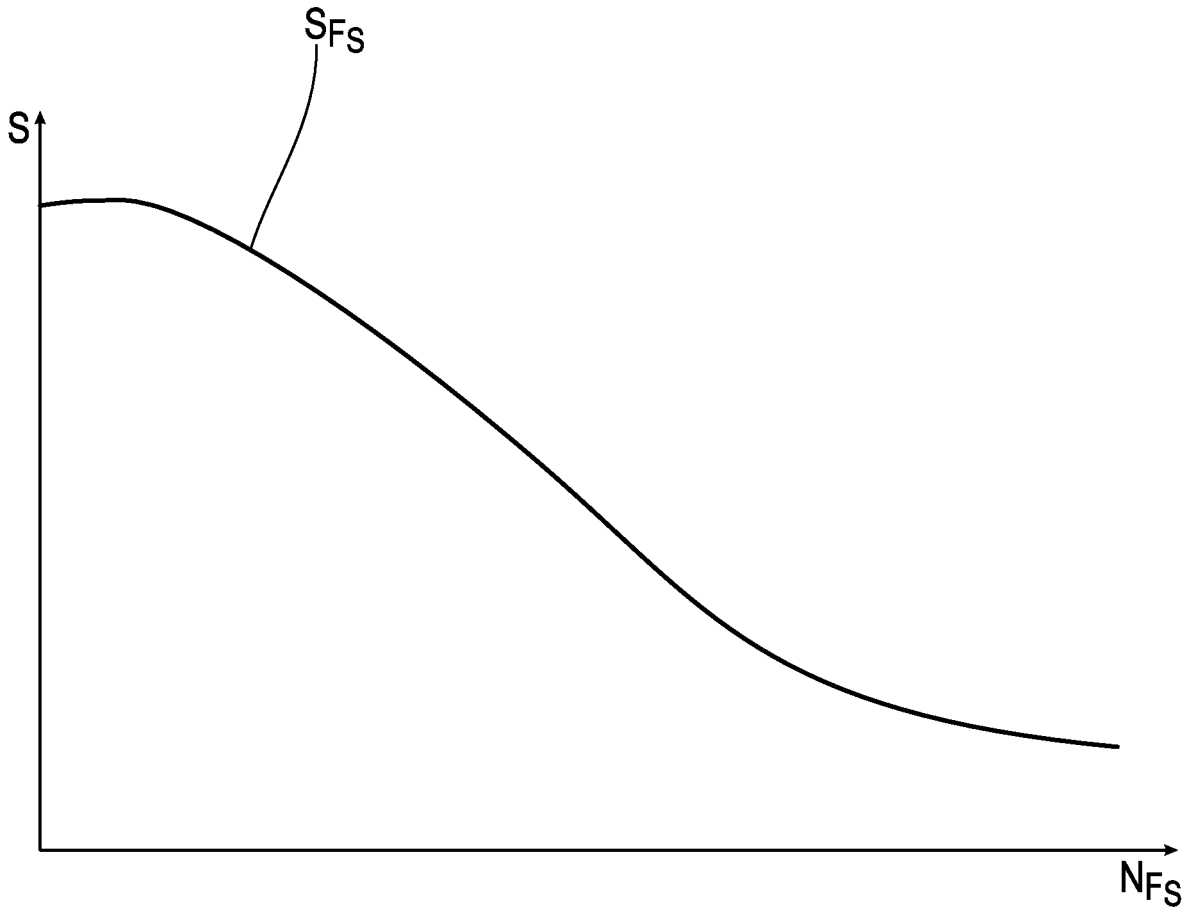

Shown in FIG. 6 is a progression of the ballast force amplitude $S_{F_S}$ over the cumulative frequency $N_{F_S}$. By comparison of the progression of the ballast force amplitude $S_{F_S}$ over the cumulative frequency $N_{F_S}$ to a maximally allowable cumulative frequency $N_{F_S}$ of ballast force amplitude $S_{F_S}$, a wear condition of the tamping unit 8 is established. The wear condition is established for individual parts of the tamping unit 8, such as the tamping tines 8*a*, the drive device 9 and the linear bearings 10, as well as for the tamping unit 8 in its entirety.

In dependence upon the strain, at least one process parameter $p_K$, $p_{KR}$, $f_S$ for operation of the tamping unit 8 is set by means of the evaluation unit 19. To that end, the evaluation unit 19 is in signal connection with the consolidation drive 8*b* for controlling the vibration frequency frames, and with the pressure regulator 20 for controlling the piston pressure $p_K$ and the piston ring pressure $p_{KR}$. Upon transgression of a threshold value SW of the strain, the at least one process parameter $p_K$, $p_{KR}$, $f_S$ is changed. To that end, the ballast force $F_S$ is compared to the threshold value SW by means of the evaluation unit 19, wherein—upon transgression of an upper threshold value $SW_1$—the at least one process parameter $p_K$, $p_{KR}$, $f_S$ is changed in such a way that the ballast force $F_S$ is reduced, wherein—in the case of falling below a lower threshold value $SW_2$—the at least one process parameter $p_K$, $p_{KR}$, $f_S$ is changed in such a way that the ballast force $F_S$ is increased. The ballast force $F_S$ is reduced by increasing the vibration frequency $f_S$ and by reducing the pressure difference between the piston pressure $p_K$ and the piston ring pressure $p_{KR}$, and is increased in the opposite manner. The process parameters $p_K$, $p_{KR}$, $f_S$ are changed by means of the evaluation unit 19 to the extent that there is an optimum between a low strain on the tamping device 5 and a high speed of treatment of the track bed 21.

As an alternative to determining the load spectrum for establishing the strain, it is also possible to determine a ballast work $W_S$ by means of the evaluation unit 19. The ballast work $W_S$ is determined from the ballast force $F_S$ and a change of the position z of the tamping unit 8. The ballast work $W_S$ corresponds to the work introduced into the track bed 21 via the tamping tines 8*a*. In this, the change of the position z is recorded via a discrete duration. This change of the position z is then multiplied by the ballast force $F_S$. The ballast work $W_S$ is determined as the sum of the products of the ballast force $F_S$ and the changes of the positions z.

Figure 7:
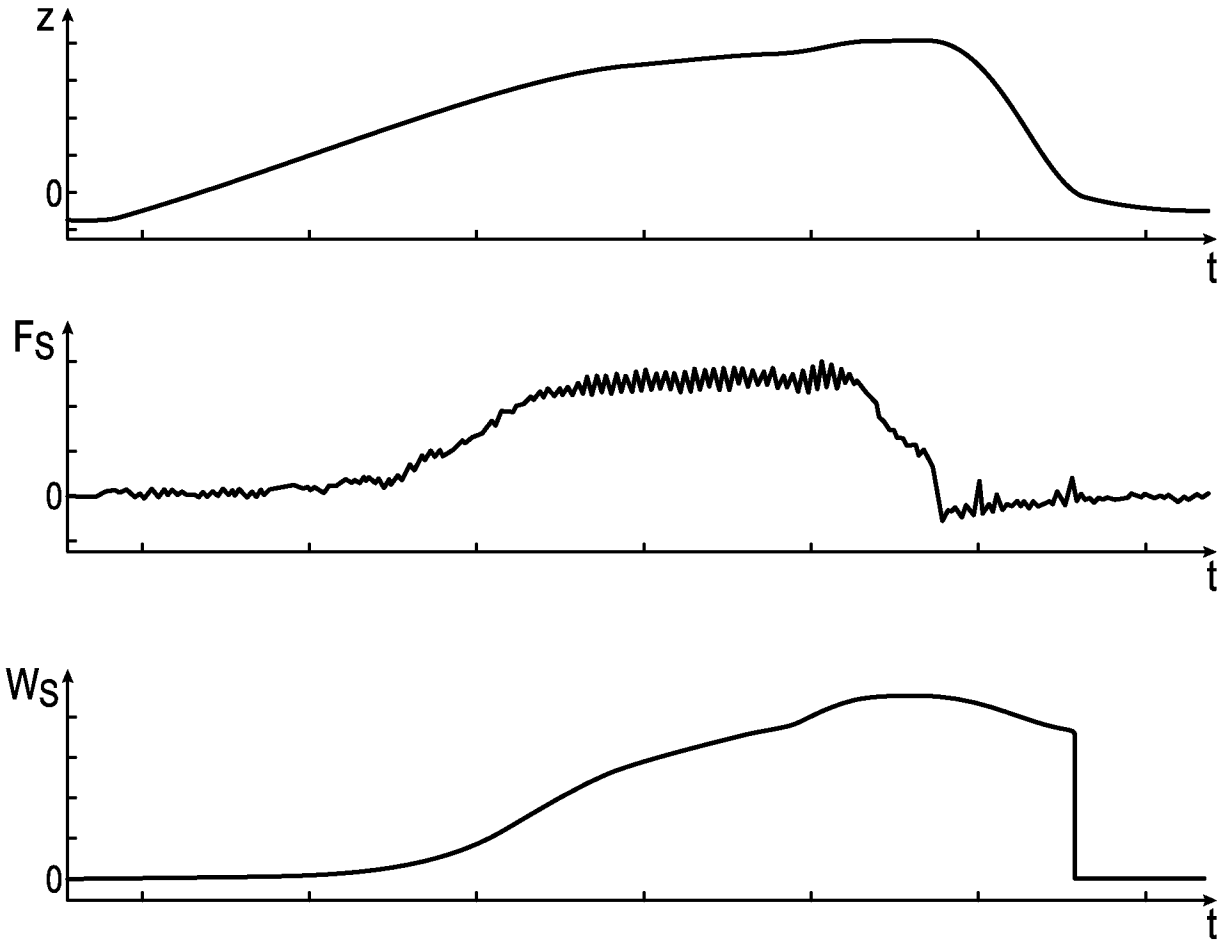

In FIG. 7, the progressions of the position z, the ballast force $F_S$ and the ballast work $W_S$ are indicated for a tamping cycle over the time t. The ballast work $W_S$ can also be understood as the area under the progression of the ballast force $F_S$ over the position z.

As a result of determining, by means of the evaluation unit 19, the ballast force $F_S$ acting on the tamping unit 8, it is possible to draw conclusions regarding the strain of the tamping unit 8. The determination of the ballast force $F_S$ while taking into account the driving force $F_A$ and additionally the acceleration $a_z$ is significantly more precise as compared to looking exclusively at the driving force $F_A$ for determining the ballast force $F_S$. The strain of the tamping unit 8 can thus be determined reliably, and a wear condition of the tamping unit 8 can be positively detected. The adjustment of the at least one process parameter $p_K$, $p_{KR}$, $f_S$ in dependence on the strain enables the efficient and economic operation of the track maintenance machine. In this, particularly by means of optimizing, a high speed of treatment, a low energy consumption and a reduced strain on the tamping unit 8 are achieved.

The invention claimed is:

1. A method of operating a tamping unit of a track maintenance machine, which comprises the steps of:

providing on a track bed the track maintenance machine having a tamping unit;

displacing the tamping unit relative to the track bed;

determining a driving force acting on the tamping unit and required for a displacement;

determining an acceleration acting on the tamping unit;

determining a ballast force, acting between the tamping unit and the track bed, by way of the driving force and the acceleration;

evaluating the ballast force, wherein the evaluating takes place in such a way that a strain acting on the tamping unit is determined by way of the ballast force; and determining a wear condition of the tamping unit based on the strain.

2. The method according to claim 1, which further comprises determining the acceleration by measuring a temporal change of a position of the tamping unit.

3. The method according to claim 1, wherein for determining the ballast force, an inertial force acting on the tamping unit is determined by means of the acceleration.

4. The method according to claim 1, wherein the displacement of the tamping unit occurs by means of a fluidically operated drive device, wherein at least one fluid pressure acting on the fluidically operated drive device is measured for determining the driving force.

5. The method according to claim 1, which further comprises determining the strain by way of a temporal progression of the ballast force.

6. The method according to claim 1, which further comprises determining the strain by means of ballast force amplitudes of the ballast force.

7. The method according to claim 6, wherein for determining the strain, a load spectrum is determined by way of a cumulative frequency of the ballast force amplitudes.

8. The method according to claim 1, wherein for determining the strain, a ballast work is determined from the ballast force and a change of a position of the tamping unit.

9. The method according to claim 1, which further comprises setting at least one process parameter for controlling the tamping unit in dependence on the strain.

10. A method of operating a tamping unit of a track maintenance machine, which comprises the steps of:

providing on a track bed the track maintenance machine having a tamping unit;

displacing the tamping unit relative to the track bed;

determining a driving force acting on the tamping unit and required for a displacement;

determining an acceleration acting on the tamping unit;

determining a ballast force, acting between the tamping unit and the track bed, by way of the driving force and the acceleration;

evaluating the ballast force, wherein the evaluating takes place in such a way that a strain acting on the tamping unit is determined by way of the ballast force;

setting at least one process parameter for controlling the tamping unit in dependence on the strain; and changing the at least one process parameter when a threshold value of the strain is exceeded or fallen below.

11. A method of operating a tamping unit of a track maintenance machine, which comprises the steps of:

providing on a track bed the track maintenance machine having a tamping unit;

displacing the tamping unit relative to the track bed;

determining a driving force acting on the tamping unit and required for a displacement;

determining an acceleration acting on the tamping unit;

determining a ballast force, acting between the tamping unit and the track bed, by way of the driving force and the acceleration;

evaluating the ballast force, wherein the evaluating takes place in such a way that a strain acting on the tamping unit is determined by way of the ballast force;

setting at least one process parameter for controlling the tamping unit in dependence on the strain; and setting the at least one process parameter such that the strain does not exceed a strain limit value.

12. A tamping device for track bed consolidation, the tamping device comprising:

a unit carrier;

a tamping machine supported on said unit carrier;

a driver for providing a driving force and for displacing said tamping machine relative to said unit carrier;

a driving force sensor system for detecting a first measuring value corresponding to the driving force;

an acceleration sensor system for detecting a second measuring value corresponding to an acceleration of said tamping machine; and an evaluation unit for determining a ballast force, acting on said tamping machine by means of the first measuring value and the second measuring value, wherein said evaluation unit is configured to determine a strain acting on said tamping unit based on the ballast force, said evaluation unit further configured to determine a wear condition of said tamping unit based on the strain.

* * * * *